US006224086B1

(12) United States Patent
Golling

(10) Patent No.: US 6,224,086 B1
(45) Date of Patent: May 1, 2001

(54) APPARATUS FOR GLIDING OVER SNOW

(76) Inventor: Eugene J. Golling, 1823 S. Hope St., Los Angeles, CA (US) 90015

( * ) Notice: Subject to any disclaimer, the term of this patent is extended or adjusted under 35 U.S.C. 154(b) by 0 days.

(21) Appl. No.: 09/271,876

(22) Filed: Mar. 18, 1999

Related U.S. Application Data

(63) Continuation-in-part of application No. 09/058,087, filed on Apr. 9, 1998, now Pat. No. 5,954,357.

(51) Int. Cl.[7] ..... A63C 9/00
(52) U.S. Cl. ..... 280/612; 280/14.22; 280/613
(58) Field of Search ..... 280/611, 612, 280/613, 623, 607, 14.21, 14.22, 14.23; 269/8

(56) References Cited

U.S. PATENT DOCUMENTS

| | | | | |
|---|---|---|---|---|
| 2,276,826 | * | 3/1942 | Crowther | 280/612 |
| 3,437,345 | * | 4/1969 | Berta | 280/612 |
| 3,667,771 | * | 6/1972 | Larson | 280/612 |
| 3,960,383 | * | 6/1976 | O'Neil | 280/612 |
| 5,474,322 | * | 12/1995 | Perkins et al. | 280/613 |
| 5,769,439 | * | 6/1998 | Svetlov | 280/87.041 |
| 6,056,312 | * | 5/2000 | Hogstedt | 280/624 |

* cited by examiner

*Primary Examiner*—J. J. Swann
*Assistant Examiner*—David R. Dunn
(74) *Attorney, Agent, or Firm*—James E. Brunton, Esq.

(57) ABSTRACT

A universal snow boot and binding for use in connection with either snow skiing of snow-boarding which is easy to use and provides quick, easy and positive interconnection of the snow boot with the upper surface of the ski or snow-board. Uniquely only magnetic forces are used to affix the snow boot to the ski or snow-board.

7 Claims, 14 Drawing Sheets

APPARATUS FOR GLIDING OVER SNOW

This is a Continuation-In-Part application of application Ser. No. 09/058,087 filed Apr. 9, 1998, U.S. Pat. No. 5,954,357.

BACKGROUND OF THE INVENTION

1. Field of the Invention

The present invention relates generally to a winter sport apparatus. More particularly, the invention concerns a novel winter sport apparatus for gliding over snow which includes unique snow boots which are removably connected to a snow engaging support base such as a snow-board or ski board through the use of magnets.

2. Discussion of the Prior Art

In recent years snow sports have continually increased in popularity. While, for many years snow skiing was the sport of choice among winter sport enthusiasts, recently, the sport of snow-boarding has catapulted into popularity particularly among young persons.

With the increase in popularity of snow boarding has come the demand for better and easier-to-use equipment. Particularly in demand is the need for superior boots and bindings. As a general rule, the boots and bindings used for snow boarding are the same as used for snow skiing and closely resemble those which have been used for over fifty years. Typically, the bindings comprise rather heavy, bulky frames which are affixed to the upper surface of the snow-board with the boots being affixed to the frames by conventional types of straps, buckles and wires of the character used in snow skiing. These type of bindings are generally cumbersome, difficult to use and often fail to provide a type of interconnection between the boots and the snow-board which is essential to the sport of snow boarding.

Among the more recent improvements in snow sport bindings are those described in U.S. Pat. No. 5,558,355 issued to Henry. The Henry patent describes a binding which is particularly suitable for snow boarding and provides an easy-to-use, kick-in boot engagement feature and a number of convenient ways to disengage the boot in a relative small, light-weight, and economical structure. Another type of ski binding is disclosed in U.S. Pat. No. 5,143,397 issued to Stepanek et al. This patent describes a part for a ski binding comprising a carriage slidably attached to a base plate. One end of the base plate is fastened to the ski with fasteners while the other end rests freely on the bottom of a U-shaped clamp also fastened to the ski with fasteners. Attachment of the carriage to the base is accomplished by carriage structural features that retain the carriage in the clamp and further carriage structural features that prevent the carriage from being vertically disengaged from the part of the base adjacent to the base plate fastened end.

Still another improved binding for a snow-board is that described in U.S. Pat. No. 5,143,369 issued to Shaanan et al. The Shaanan et al patent concerns a binding for a snow-board that has a base, side members extending upwardly and rearwardly from the sides of the base with an arcuate member joining the rear ends of the side members. Fastening means on one of the side members and one side edge of the board at the front provide for attachment of one end of two straps. Fastening means on the other side member and on the other side edge serve for attachment of a locking bar which, in turn, connects the other end of each strap to the side member and base.

The foregoing prior art patents represent some of the more recent attempts to improve the quality of snow boots and bindings particularly for use in connection with snow boarding. While the devices disclosed in the aforementioned patents constitute substantial improvements over the prior art, they nevertheless remain somewhat complicated, bulky and difficult to use.

The thrust of the present invention is to overcome the drawbacks of the prior art snow-ski and snow-board boots and bindings and to provide a universal boot and binding which is easy to use and enables the quick and positive interconnection of the snow boots with the upper surface of the ski or snow-board.

SUMMARY OF THE INVENTION

It is an object of the present invention to provide a universal snow boot and binding for use in connection with either snow skiing or snow boarding which is easy to use and provides quick, easy and positive interconnection of the snow boot with the upper surface of the ski or snow-board. More particularly, it is an object of the invention to provide a highly novel snow boot and binding in which only magnetic forces are used to affix the snow boot to the ski or snow-board.

Another object of the invention is to provide an apparatus of the character described in the preceding paragraphs which is light-weight, is simple to manufacture and install, and is virtually fail-safe in operation.

Another object of the invention is to provide an apparatus of the afore-mentioned character which includes novel means for quickly and easily disconnecting the snow boot from the upper surface of the snow-board or snow ski which carries the magnetic elements of the apparatus.

Another object of the invention is to provide an apparatus as described in the preceding paragraph in which the release mechanism comprises an easy-to-use, hand-operated lever which enables the skier or the snow-boarder to quickly and easily disconnect the snow boot from the upper surface of the ski or snow-board.

Another object of the invention is to provide cooperating gripping means on the snow boot and the magnet to prevent accidental slippage of the snow boot relative to the magnet.

Another object of the invention is to provide a novel ski boot and cooperating binding which is compact, lightweight and of a simple, straight forward construction that and can be inexpensively manufactured.

DESCRIPTION OF THE INVENTION

Figure 1:
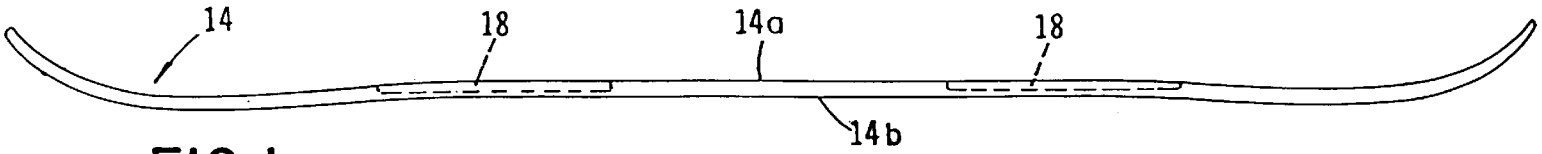
FIG. 1 is a side-elevational view of the support base portion of one form of the apparatus of the invention for gliding over snow.
Figure 2:
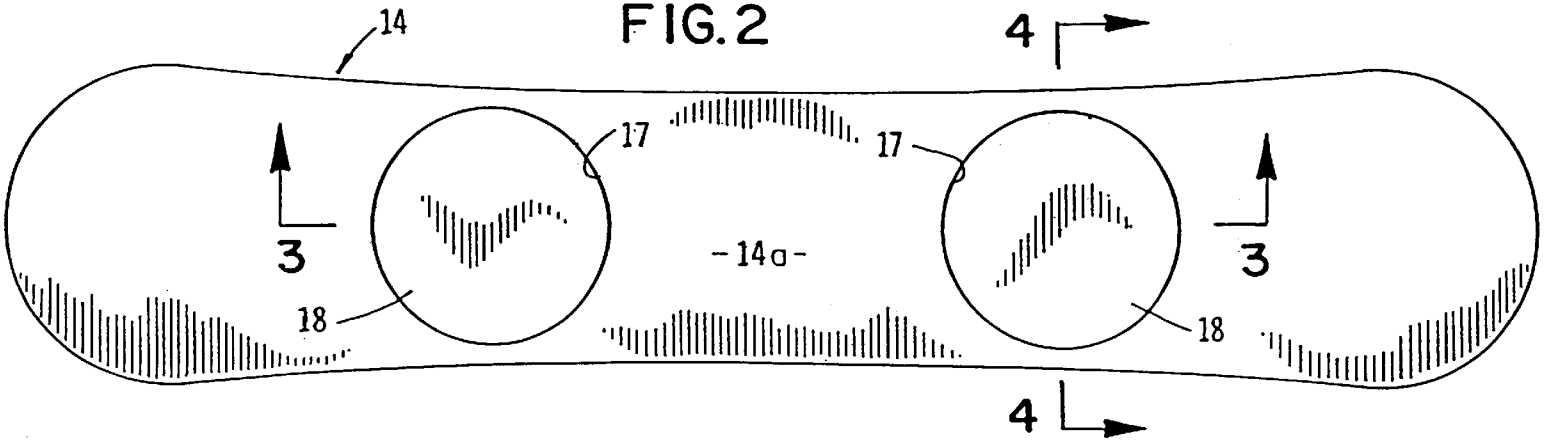
FIG. 2 is a top plan view of the support base shown in FIG. 1.
Figure 3:
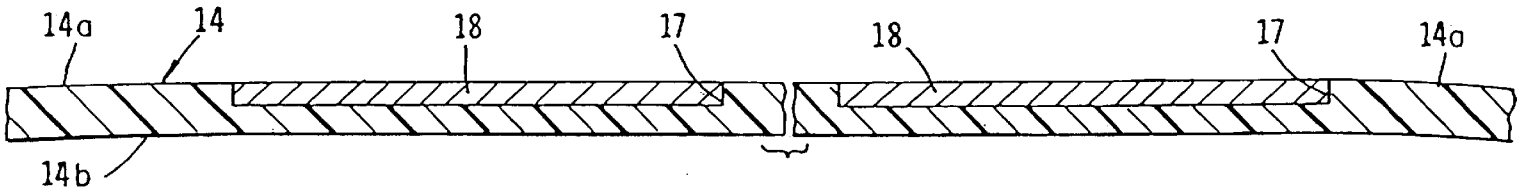
FIG. 3 is an enlarged, cross-sectional view taken along lines 3—3 of FIG. 2.
Figure 4:
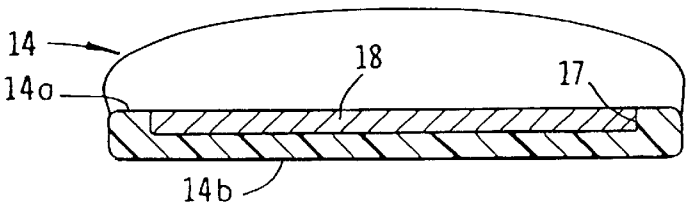
FIG. 4 is an enlarged, cross-sectional view taken along lines 4—4 of FIG. 3

Referring to the drawings and particularly to FIGS. 1 through 7, one form of the apparatus of the invention for gliding over snow is there shown. In this form of the invention, there are three principal cooperating components, namely, a support base 14, a foot enclosure assembly 16, and release means connected to the foot enclosure assembly for releasably interconnecting the foot enclosure assembly with the support base. Support base 14 includes an upper surface 14*a* and a lower surface 14*b* and, in the form of the invention shown in FIGS. 1 and 2, comprises a snow-board. As best seen in FIGS. 3 and 4, the upper surface 14*a* of support base 14 is provided with a pair of spaced-apart, generally circular shaped recesses 17 within which is mounted a generally circular shaped magnet 18. Magnets 18 are of a high holding power, compact design, and can be constructed from various materials. By way of example, magnets 18 can comprise powerful ceramic ring, permanent magnets which are readily commercially available from various sources including A-L-L Magnetics, Inc. of Palencia, Calif. These ceramic magnets can be constructed in various configurations and, if desired, can be encased in nickel-plated steel cups. Magnets 18 are commercially available in a number of different sizes and range in diameter from about 2 inches to about 5 inches. The larger of these magnets exhibit holding power of on the order of 200 pounds per magnet.

It is to be understood that in constructing the apparatus of the present invention, a single relatively large magnet can be used, or in the alternative, a plurality of smaller magnets disposed in a suitable array can be used to provide the magnetic forces necessary to releasably secure the foot enclosure assembly of the apparatus to the support base. By way of example a snow-board of a nominal length will require one magnet per foot enclosure with a pulling strength of about 150 pounds per magnet. This will achieve a total pulling strength of 300 pounds. The average weight of a person using a snow-board will typically be about 150 pounds. The magnets will then have double the pulling strength of the weight to be held in the desired position on the snow-board.

Figure 5:
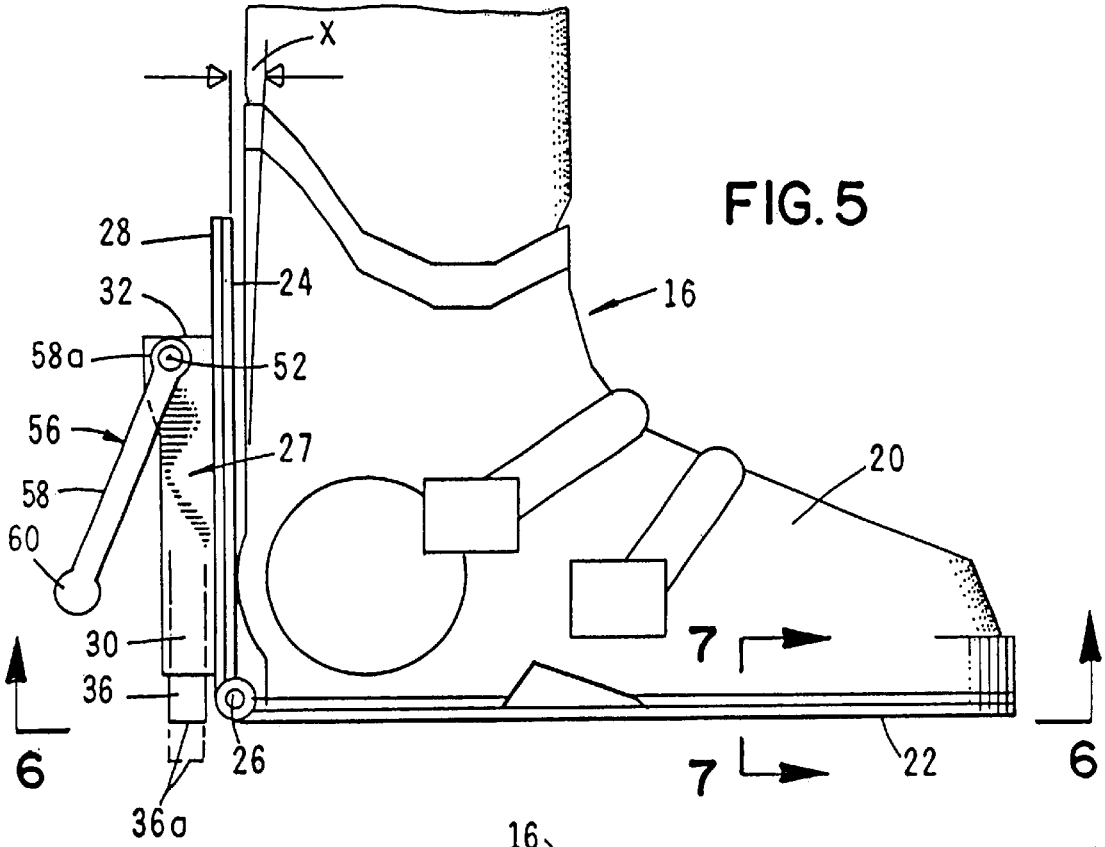
FIG. 5 is a side-elevational view of one form of the foot enclosure assembly of the apparatus of the invention.
Figure 6:
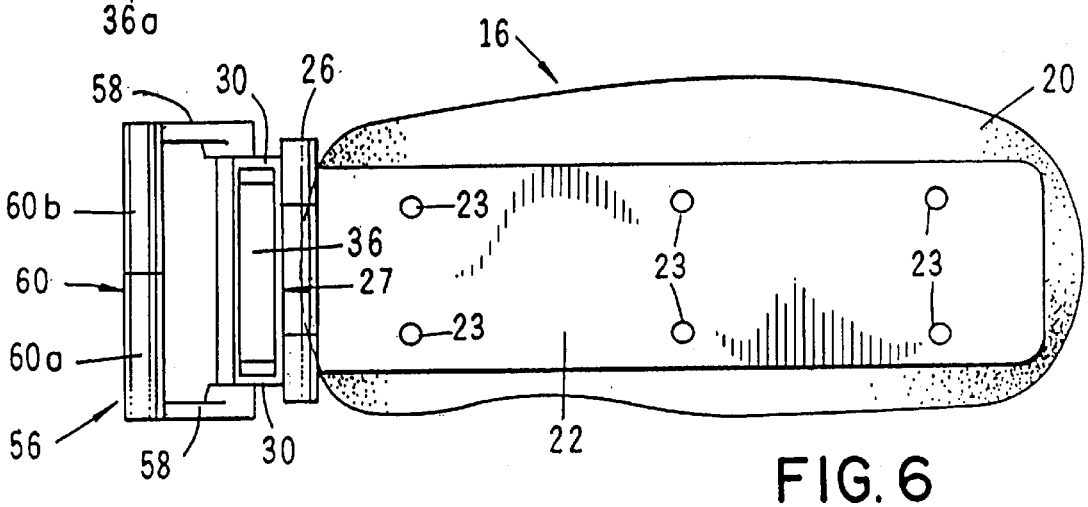
FIG. 6 is a view taken along lines 6—6 of FIG. 5.
Figure 7:
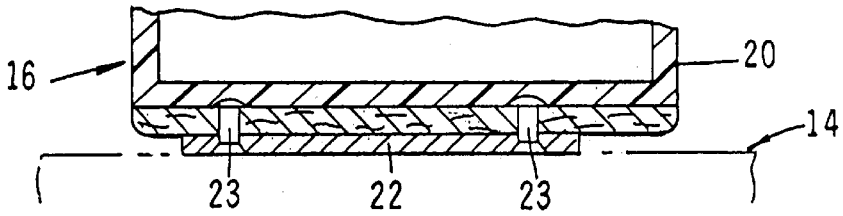
FIG. 7 is a greatly enlarged, cross-sectional view taken along lines 7—7 of FIG. 5.
Figure 8:
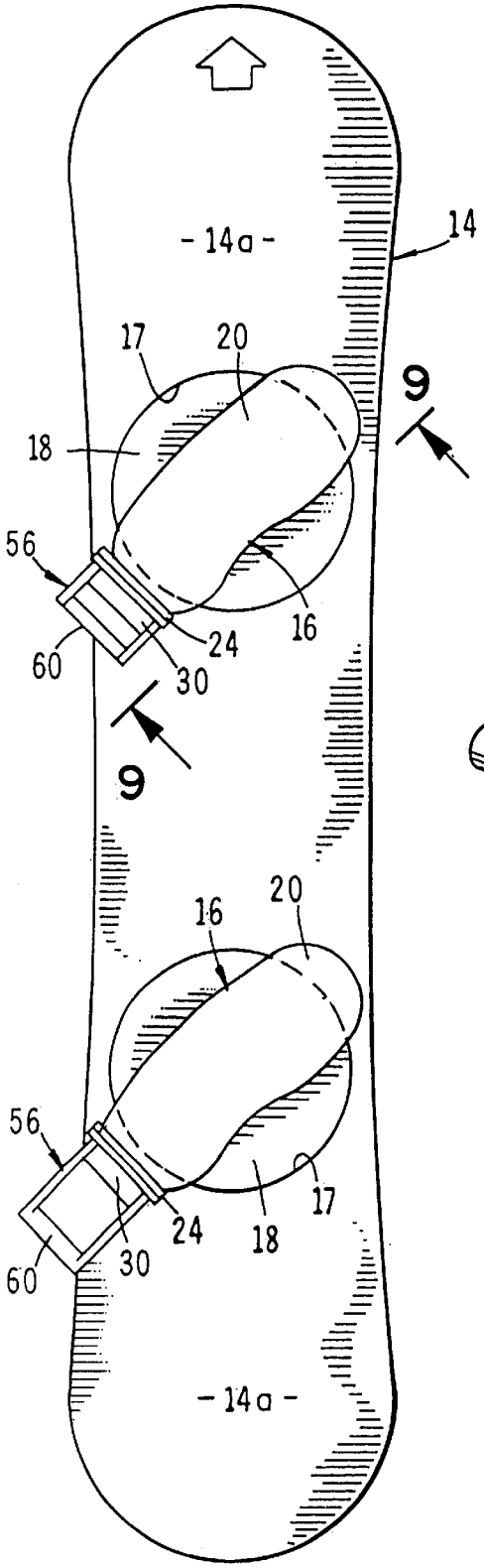
FIG. 8 us a top plan view similar to FIG. 2 but showing the foot enclosure assembly of the invention in position on the support base of the apparatus.

Referring to FIG. 5, the foot enclosure assembly 16 of the present invention can be seen to comprise a snow boot-like foot enclosure 20 and a first metal plate 22 which is affixed to the lower surface of the snow boot 20 by any suitable means such as rivets 23 (FIGS. 6 and 7). Plate 22 may be constructed from any suitable rigid metal which is capable of being attracted by the magnets 18 which are interconnected with the support base 14 by adhesive bonding or any other suitable means.

Also forming a part of the foot enclosure assembly of the invention is a second plate 24 which is pivotally connected to plate 22 for very limited movement of a few degrees about a pivot pin 26. More particularly, as shown in FIG. 5, plate 24 extends upwardly from plate 22 and normally is disposed generally perpendicularly with respect thereto. Plate 24 functions to provide support to the heel portion of the foot enclosure 20, but permits slight forward movement through a limited distance of X (FIG. 5). However, plate 24 positively resists rearward angular movement of the rear portion of the boot and lower leg of the user. The distance X can, of course, vary depending upon the physical stature of the user, but generally is on the order of about 1 inch. This movement is sufficient to permit the skier or snow boarder to comfortably lean forward in the binding but, at the same time, provides support against rearward angular leaning movement relative to plane of the support base.

Forming an important feature of the apparatus of the present invention is the release means for releasing the foot enclosure assembly from the support base. As best seen by referring to FIGS. 14 and 15, the release means here comprises a guide frame 27 which includes a rear plate 28 that is securely affixed to plate 24 of the foot enclosure assembly. Protruding rearwardly from plate 28 are a pair of transversely spaced-apart side members 30 and a top closure plate 32. Spaced-apart sides 30, along with a back wall or rear plate 38, cooperate to define a guideway 34 (FIG. 14) within which a release plate 36 is telescopically movable from the first upper position shown in FIG. 11 to the second, release position shown in FIG. 14. Rear plate 38 is provided with a vertically extending, elongated guide slot 40 (FIG. 13), which guides the vertical travel of a guide pin 42 which is affixed to release plate 36. With this construction, as release plate 36 moves from the first position shown in FIG. 11 to the release position shown in FIG. 14, guide pin 42 moves from a position proximate the upper extremity of guide slot 42 (FIG. 11) to a second position proximate the lower extremity of the guide slot 40 (FIG. 14).

Figure 15:
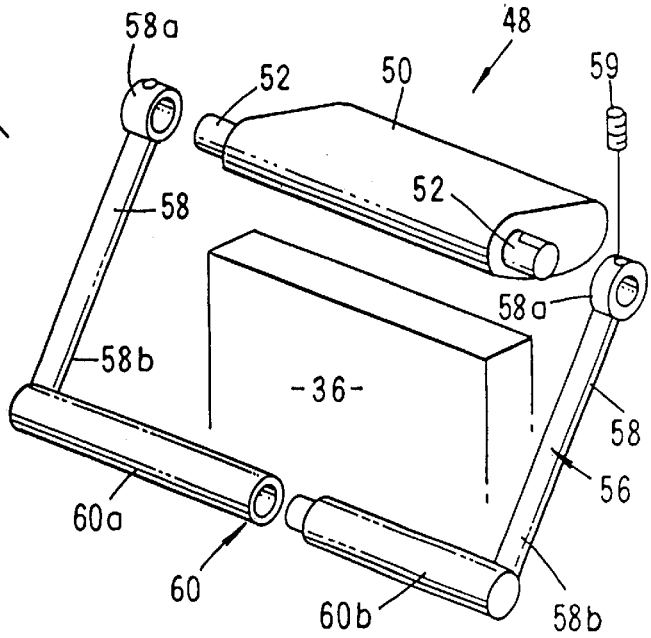
FIG. 15 is a generally perspective view of the upper portion of the release means of the apparatus of the invention for separating the foot enclosure from the support base.
Figure 10:
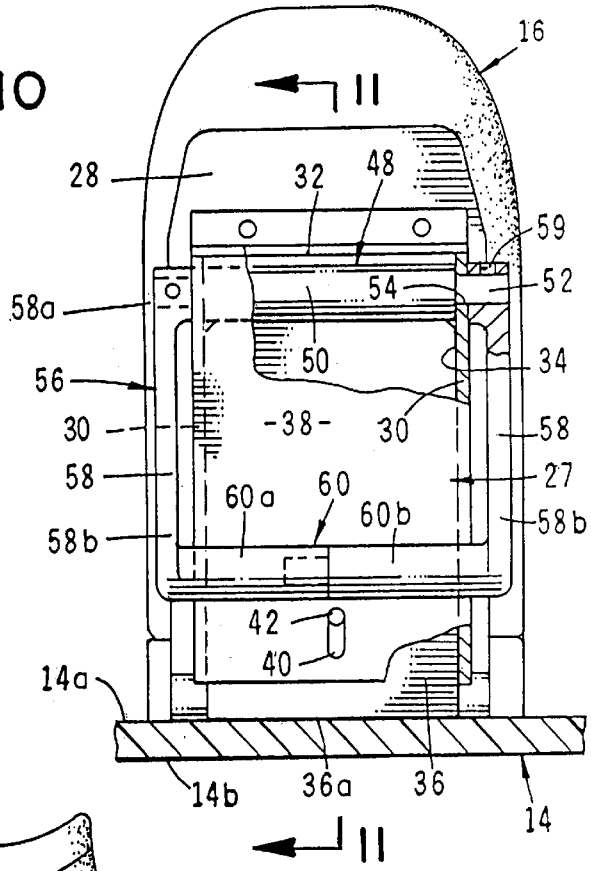
FIG. 10 is a view taken along lines 10—10 of FIG. 9.
Figure 9:
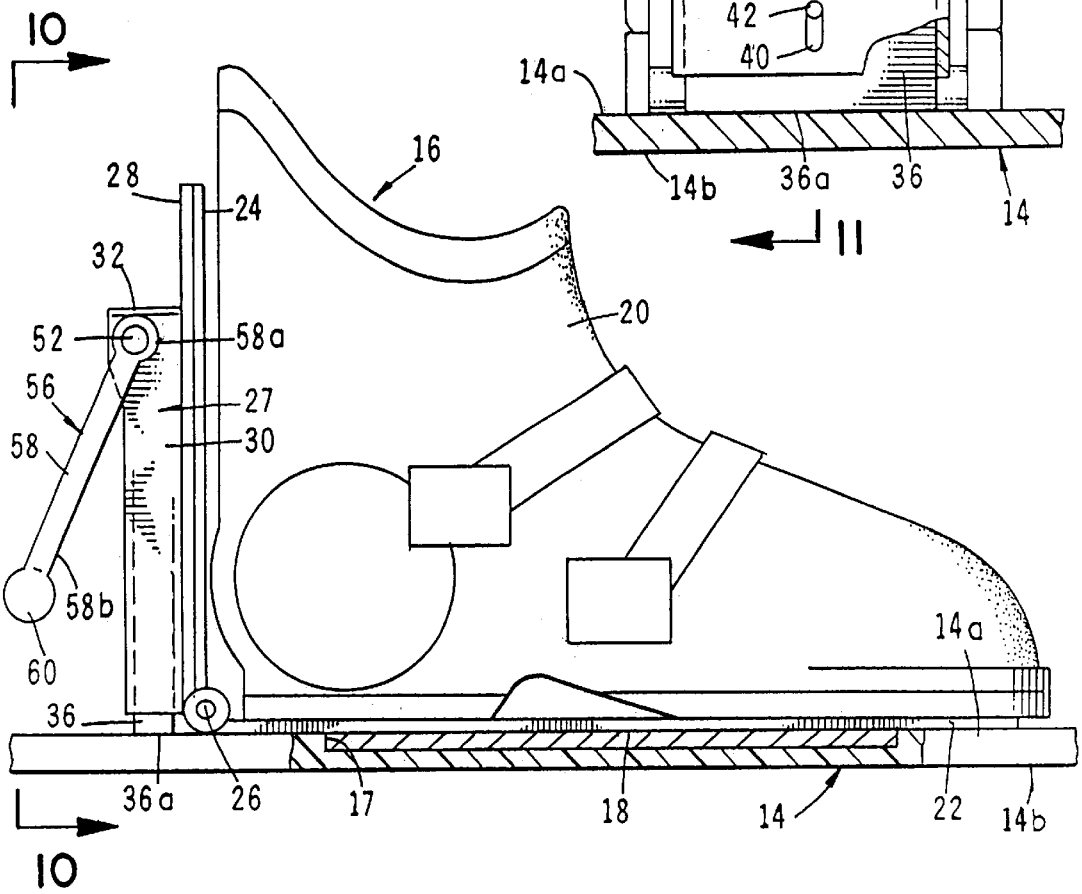
FIG. 9 is an enlarged view taken along lines 9—9 of FIG. 8.
Figure 11:
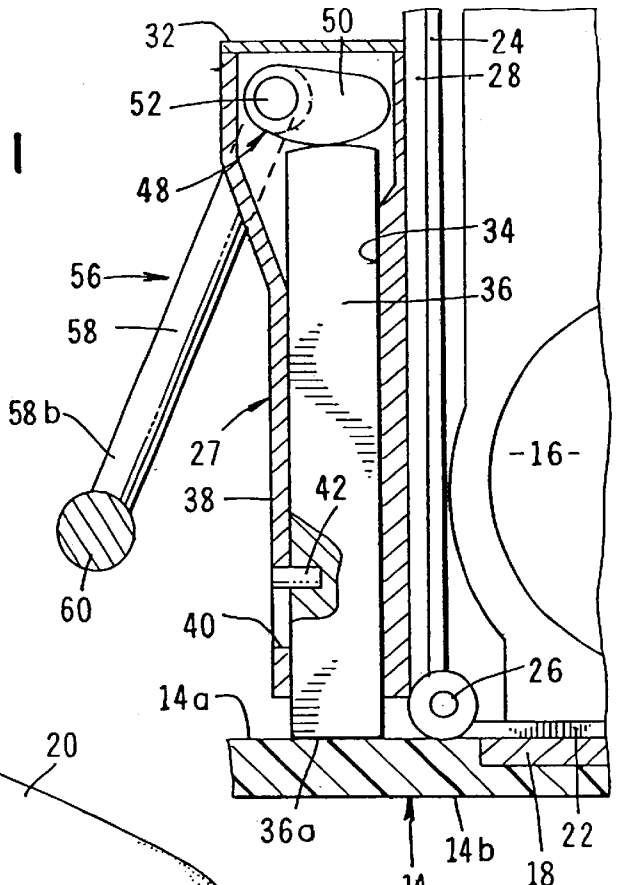
FIG. 11 is a cross-sectional view taken along lines 11—11 of FIG. 10.
Figure 12:
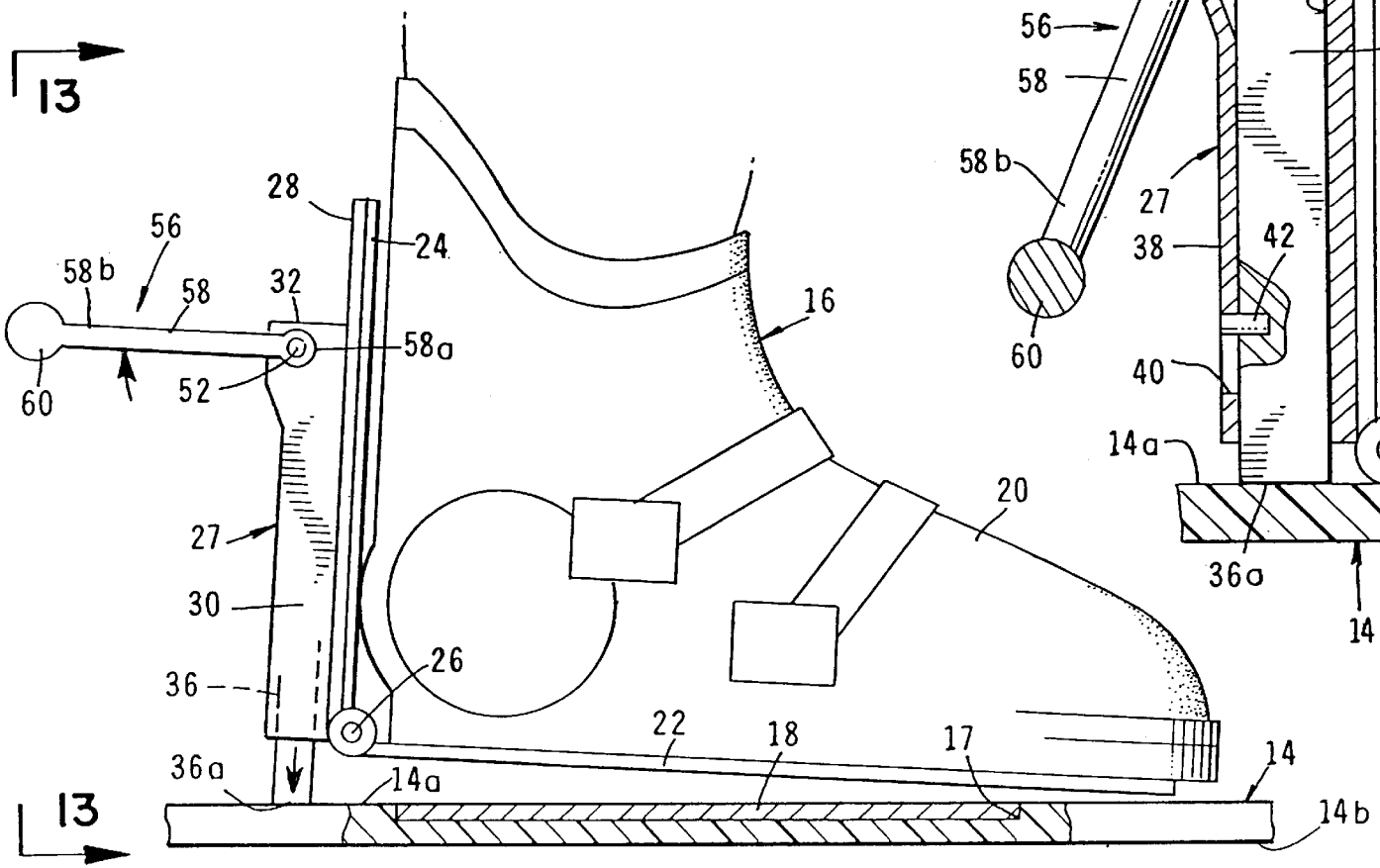
FIG. 12 is a side-elevational view similar to FIG. 5, but illustrating the manner of operation of one form of the operating means of the invention for disengaging the foot enclosure assembly from the magnet affixed to the support base.
Figure 14:
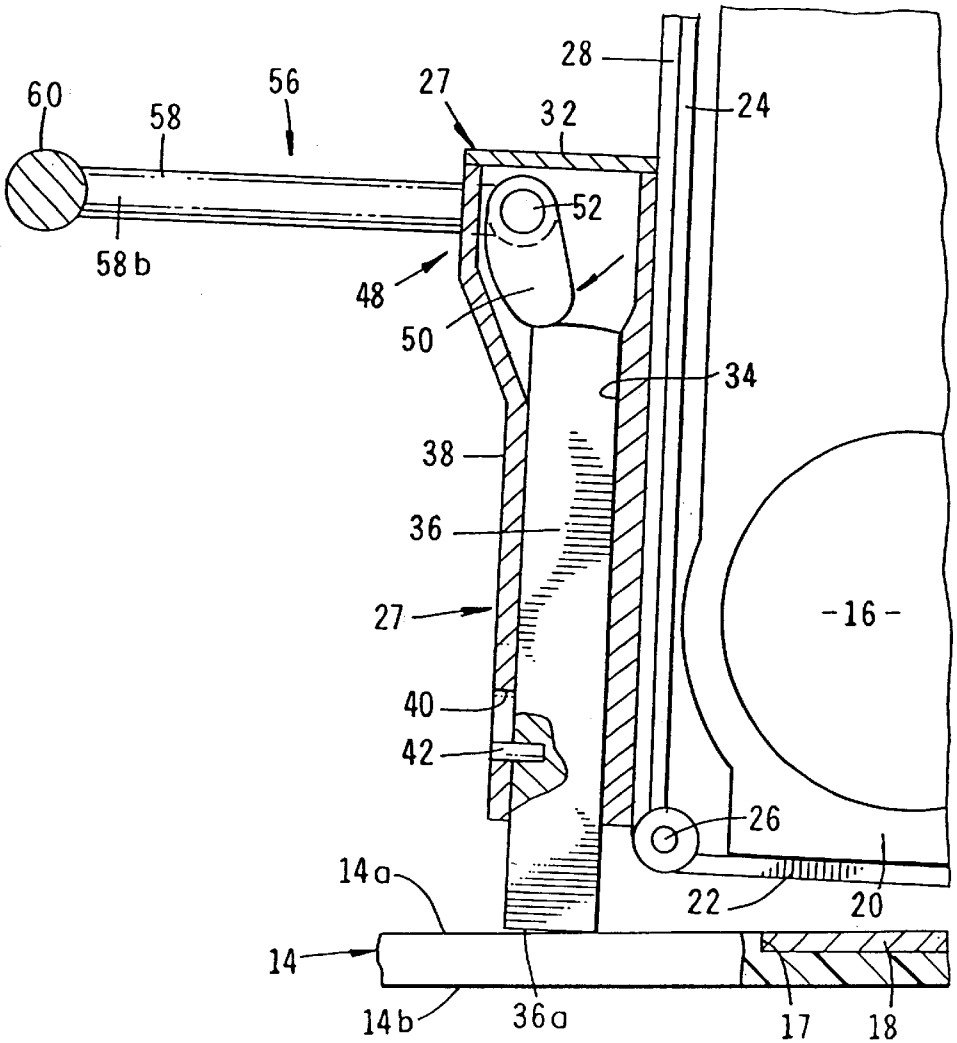
FIG. 14 is an enlarged, cross-sectional view taken along lines 14—14 of FIG. 13.
Figure 13:
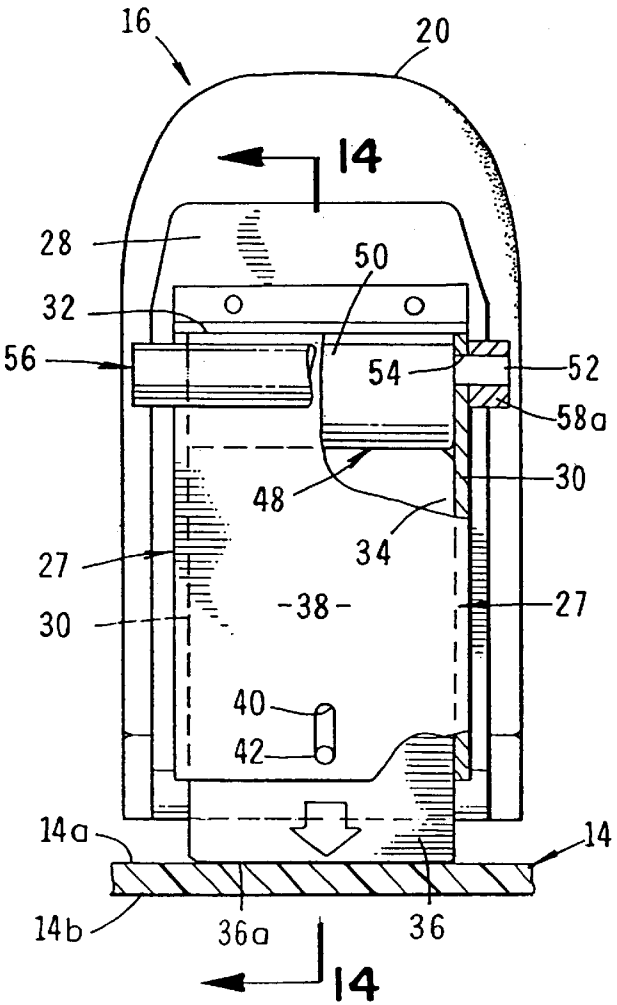
FIG. 13 is a view taken along lines 13—13 of FIG. 12.

In the embodiment of the invention shown in the drawings, release plate 36 is controllably moved from the uppermost position shown in FIG. 11 to the release position shown in FIG. 14 by operating means which here comprises as a cam assembly 48. Cam assembly 48 includes a cam member 50 having outwardly extending bosses 52 which are affixed at either side of the cam member in the manner shown in FIG. 15. As shown in FIG. 13, bosses 52 extend through aligned openings 54 provided in side walls 30 of FIG. 26. With this constrtuction, a handle assembly 56 can be used to pivot cam member 50 from the position shown in FIG. 11 to the release position shown in FIG. 14. Handle assembly 56 of the character best seen in FIG. 15. As there shown, handle assembly 56 includes two spaced-apart side arms 58, each of which terminates at its upper end in a generally annular shaped connector 58*a* which is connected to bosses 52 of cam member 50 by suitable connectors such as a set screw 59 (FIG. 15). The opposite, or out board end 58*b* of each of the arm 58 is connected to a two-part handle member 60 comprising portions 60*a* and 60*b*. When portions 60*a* and 60*b* are interconnected in the manner shown in FIG. 10 the handle member can be grasped by the user in a manner to move the handle assembly from the position shown in FIG. 11 to the upward release position shown in FIG. 14. As shown in FIGS. 11 and 14, as the handle assembly is pivoted upwardly, release plate 36 will be forced downwardly by cam member 50 causing the lower extremity 36*a* thereof to move into pressural engagement with the upper surface 14*a* of the support base. As the handle assembly is urged upwardly in the manner shown in FIGS. 12 and 14, release plate 36 will be urged downwardly so that plate 22 will be separated from the magnet 18 thereby breaking the magnetic attraction and allowing separation of the foot enclosure assembly from the support base. Following separation of the foot enclosure assembly from the base plate, the handle assembly is, of course, pivoted downwardly into the starting position so that the foot enclosure assembly can, at such time as is desired, be reconnected to the base plate by superimposing plate 22 over a selected one of the magnets 18.

Figure 16:
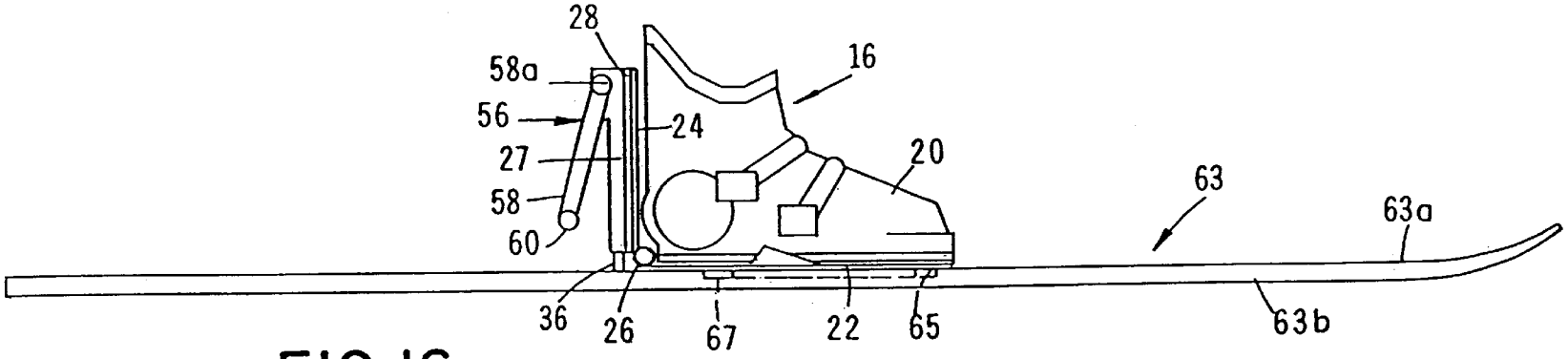
FIG. 16 is a side-elevational view of the apparatus of the invention for gliding over snow. In this form of the invention, the support base as shown in the form of a conventional ski rather than a snow-board.
Figure 17:
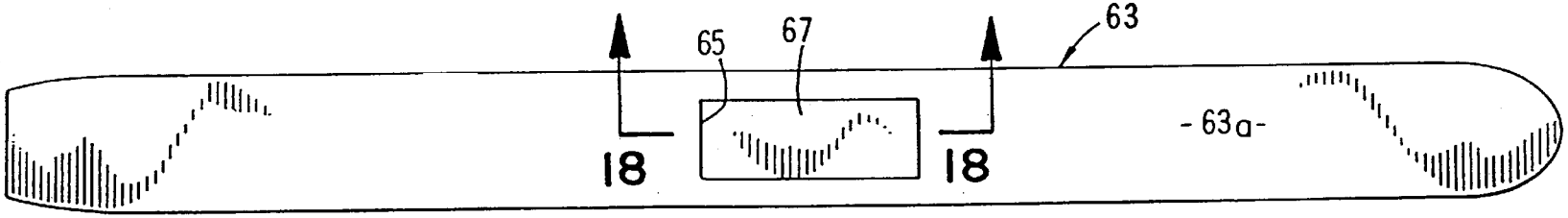
FIG. 17 is a top plan view of the support base portion of the apparatus shown in FIG. 16.
Figure 18:
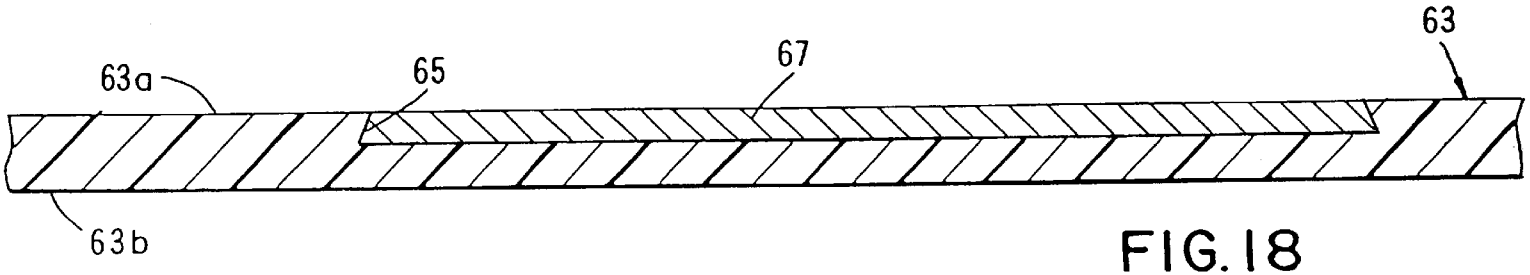
FIG. 18 is a greatly enlarged, cross-sectional view taken along lines 18—18 of FIG. 17.
Figure 19:
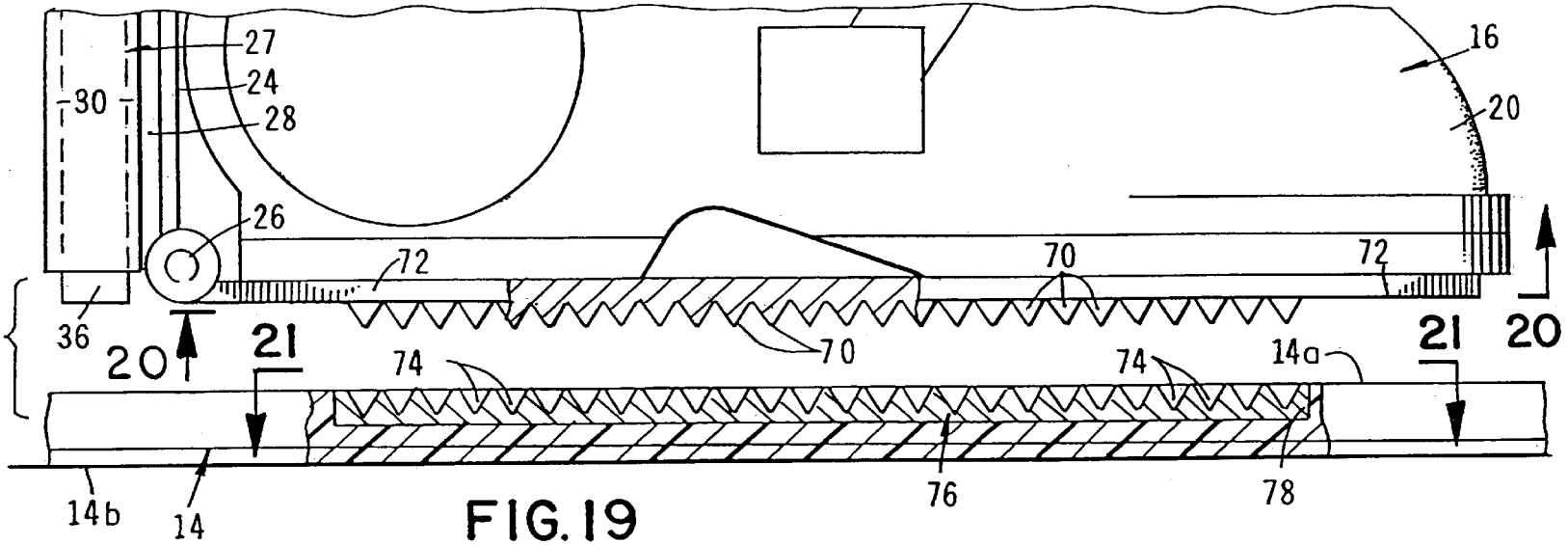
FIG. 19 is a side-elevational, exploded view, partly in cross-section showing an alternate embodiment of the invention.
Figure 22:
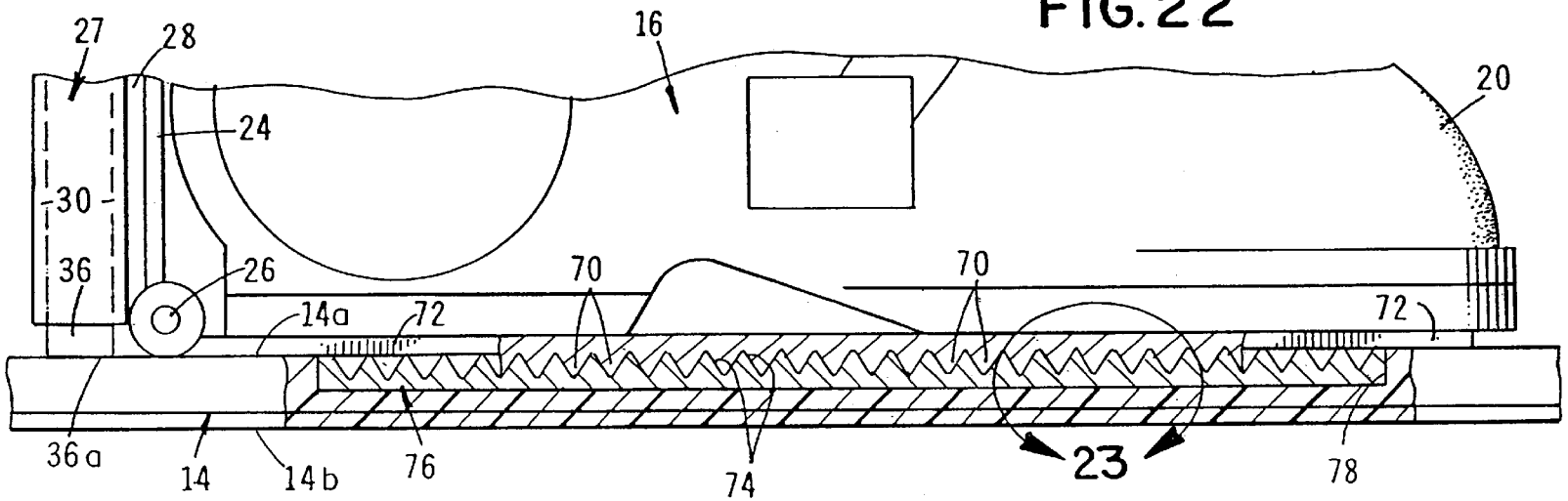
FIG. 22 is a side-elevational view similar to FIG. 19 but showing the foot enclosure assembly in engagement with the specially configured magnet.
Figure 20:
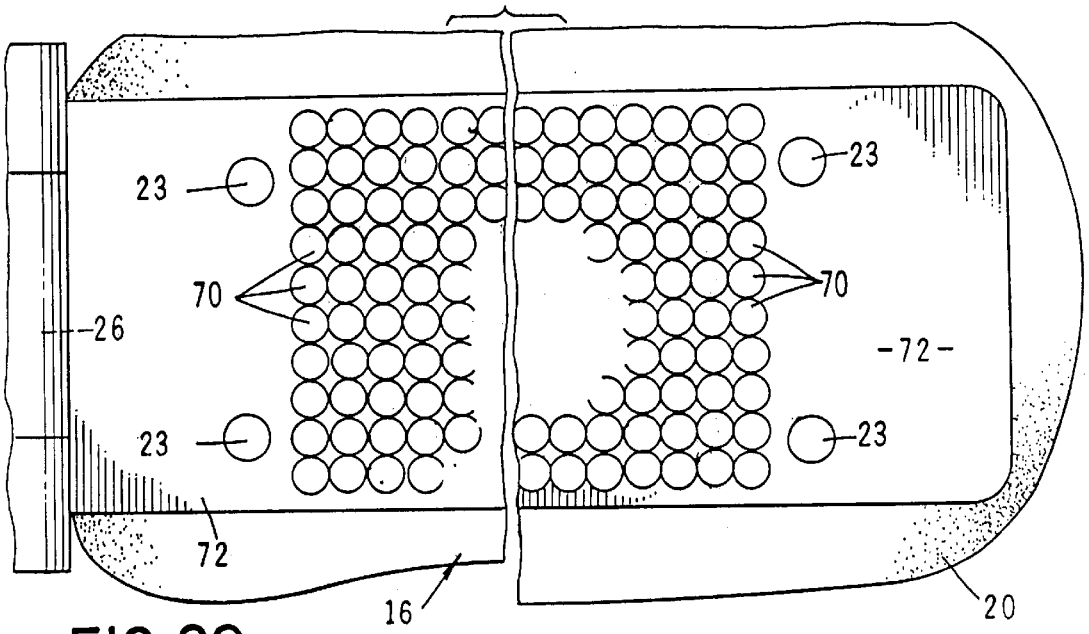
FIG. 20 is a foreshortened view taken along lines 20—20 of FIG. 19.

Turning next to FIGS. 16 through 18, an alternate form of the apparatus of the present invention for gliding over snow is there shown. This apparatus is similar in many respects to the apparatus shown in FIGS. 1 through 15. However, in this latest form of the invention the support base, rather than being a snow-board, comprises a ski 63 of a generally conventional configuration. Ski 63 has an upper surface 63*a*, and a lower snow engaging surface 64*b*. Upper surface 63*a* is provided with a generally rectangular shaped cavity 65 within which is affixed permanent magnet 67. Magnet 67 is of the same character as the magnets 18 previously discussed herein and is preferably constructed from a powerful magnetizable ceramic or metal material . Once again, magnet 67 should be designed to apply a force of approximately 150 pounds on the metal plate of the foot enclosure assembly which is identical to that previously described. Because the foot enclosure assembly, as well as the release means of this second apparatus of the apparatus is identical to that described in connection with FIGS. 1 through 15, like numerals are used in FIG. 16 to identify like components of the foot enclosure assembly and release means. It is to be understood that when two skis are used, each ski is of the general construction shown in FIGS. 16 and 17 with each ski being provided with a magnet receiving cavity 65 and an appropriately powerful permanent magnet 67 embedded therewithin. Use of the release means of the invention to release the foot enclosure assembly from the ski is accomplished in the same manner as previously described herein.

Figure 23:
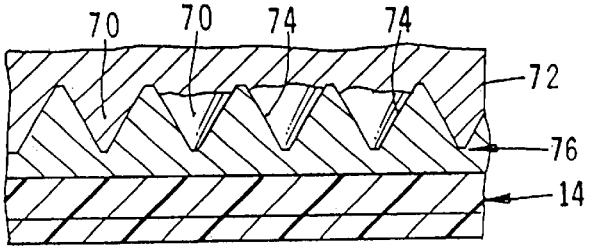
FIG. 23 is an enlarged, fragmentary view of the area designated in FIG. 22 by the numeral 23.

Turning to FIGS. 19 through 23, still another alternate form of the apparatus of the invention is there shown. This apparatus is similar in many respects to that illustrated in FIGS. 1 through 18 and like numerals are used in FIGS. 19 through 23 to identify like components. The major difference between the apparatus of the invention shown in FIGS. 19 through 23 and the earlier-described embodiments of the invention resides in the provision of anti-slip gripping means on the first metal base plates of the foot enclosure assemblies and on the magnets which are affixed to the support base of the apparatus. As best seen by referring to FIGS. 19 and 20, the g&ripping means provided on the metal base plates of each of the foot enclosure assemblies of the invention here comprises a multiplicity of downwardly extending, generally conically shaped, spike-like protuberances 70. Protuberances 70 extend downwardly from the central portion of metal base plate 72 of the foot enclosure assemblies of this latest form of the invention and as indicated in FIG. 23, are generally conical in shape.

Figure 21:
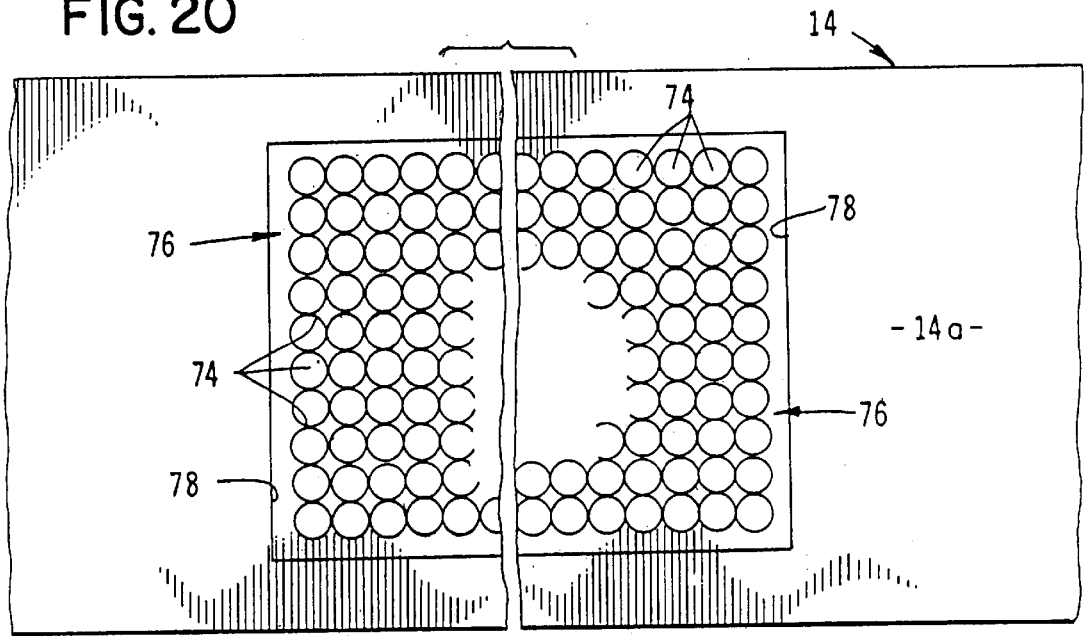
FIG. 21 is a foreshortened view taken along lines 21—21 of FIG. 19.

Also forming a part of the gripping means of this latest form of the apparatus of the invention are a multiplicity of generally conically-shaped cavities 74 which are formed in magnet 76 of this latest form of the invention. Depressions, or cavities 74, are of the same general size and configuration as conically shaped protuberances 70 so that when the foot enclosure assemblies are mated with the magnets, protuberances 70 will be received within cavities 74 so as to prevent slippage between metal plate 72 of the foot enclosure assemblies and magnets 76 which are affixed to support base 14. As best seen in FIG. 21 in this latest form of the invention, magnets 76 are generally rectangular in shape and are suitably secured within rectangularly shaped cavities 78 formed in the support bases.

It is to be understood that protuberances 70 can be of a number of different shapes. For example, the protuberances can comprise spaced-apart downwardly extending ribs which can be received within mating grooves provided in the magnets or, alternatively, they could be generally hub-like in shape and be received within socket-like cavities provided in the magnets. In any case, so long as the protuberances when received in mating cavities formed in the magnet function to prevent slippage between the foot enclosure assemblies and the magnets, their precise configuration is unimportant. In a similar fashion, the gripping means of the invention could comprise cooperating side frames provided on the foot enclosure assemblies and the magnet or support base to resist sliding movement of the foot enclosure assemblies relative to the support base.

Referring next to FIGS. 24 through 32, yet another form of the apparatus of the invention for gliding over snow is there shown and generally designated by the numeral 82. This form of the invention is similar in some respects to the earlier described embodiments and like numbers are used to identify like components. In this latest embodiment of the invention there are four principal cooperating components, namely, a support base 84, a foot enclosure means for enclosing the ulser's foot, connector means for releasably connecting the foot enclosure means to the connector means and release means for releasing the foot enclosure means from the connector means.

Figure 24:
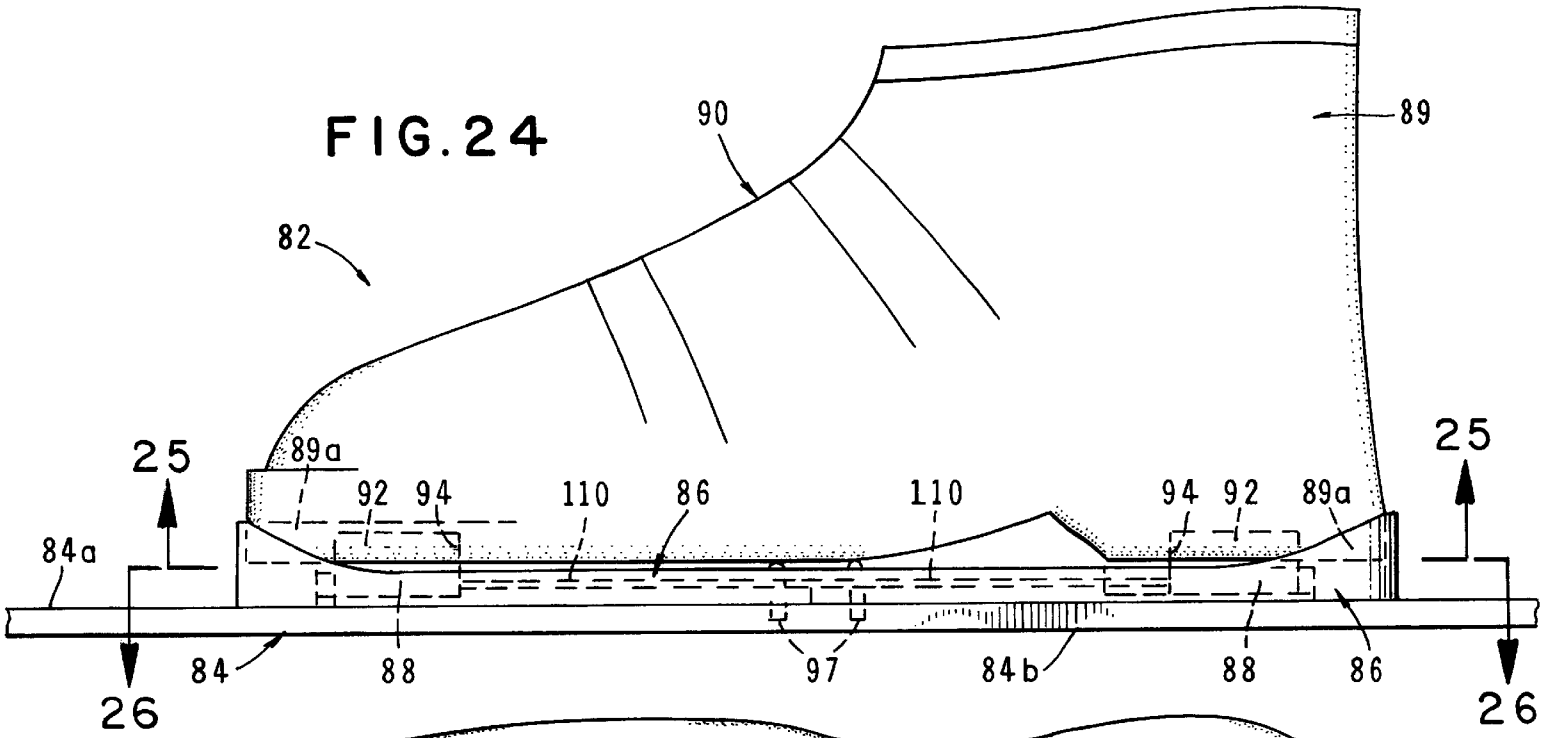
FIG. 24 is a side-elevational view of yet another form of the apparatus of the invention.
Figure 25:
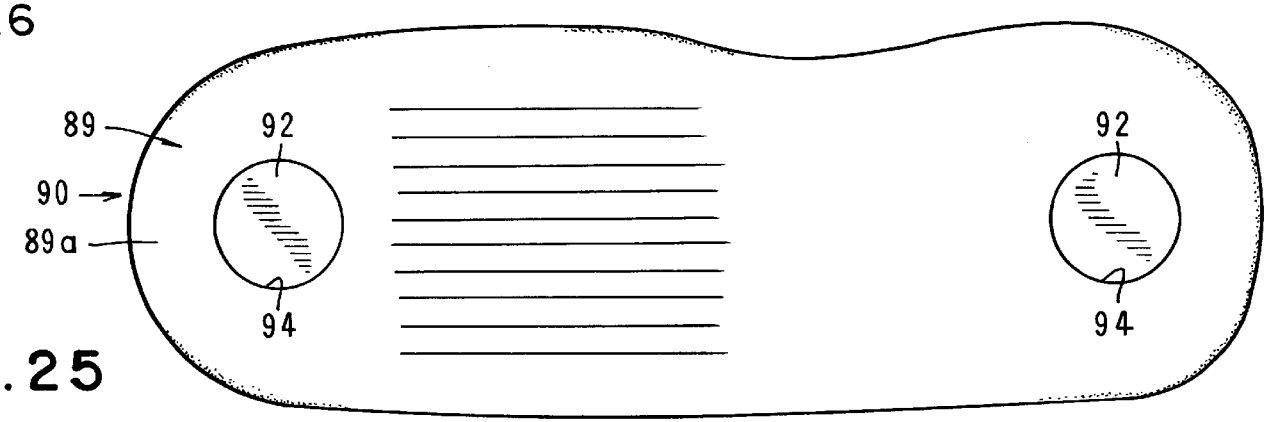
FIG. 25 is a view taken along lines 25—25 of FIG. 24.
Figure 26:
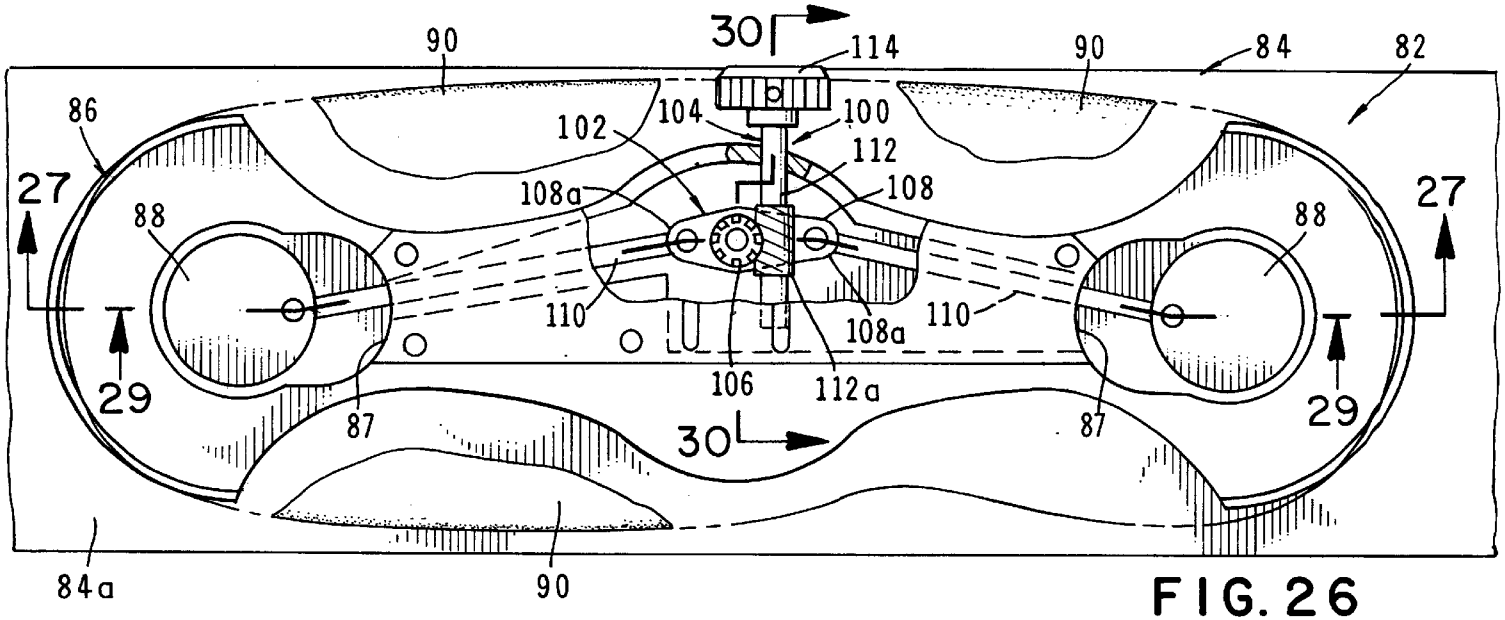
FIG. 26 is a view taken along lines 26—26 of FIG. 24 partly broken away to show internal construction.
Figure 27:
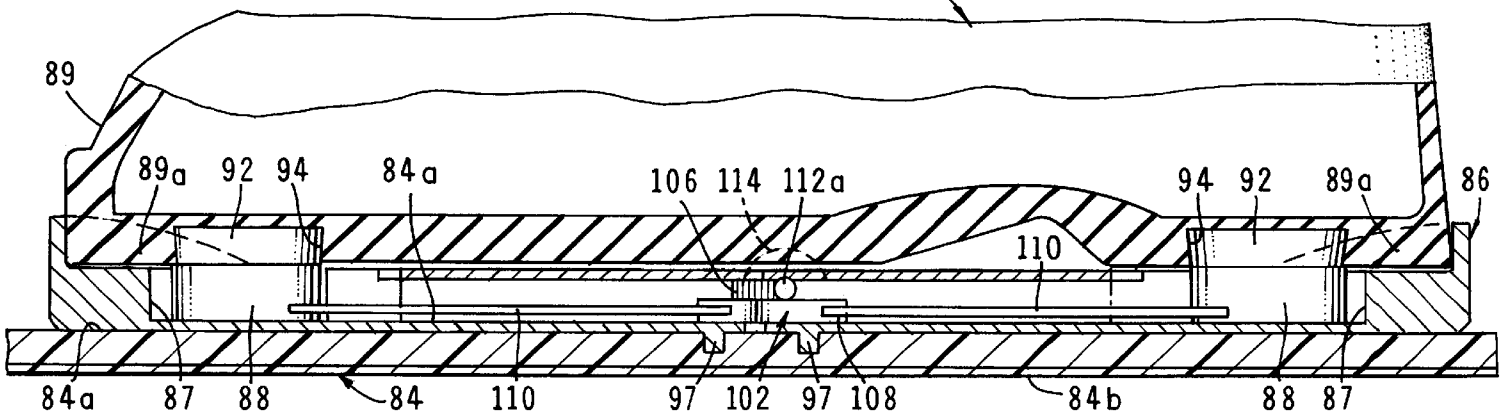
FIG. 27 is a cross-sectional view taken along lines 27—27 of FIG. 26.

As best seen in FIGS. 24, 26 and 27, the connector means of the invention includes a connector frame 86 that is provided with a pair of spaced-apart, generally oval shaped recesses 87 within which generally circular shaped second magnets 88 are slidably mounted. As before, magnets 88 are of a high holding power, compact design, and can be constructed from various materials of the character previously described herein. Connector frame 86 is connected to the upper surface 84*a* of the support base which surface is spaced apart from the lower surface 84*b* that is adapted to glide over the snow.

The foot enclosure means of the invention comprises a foot enclosure assembly 90, which includes a snow boot 89 having a pair of magnets 92 affixed to the sole 89*a* thereof by any suitable means such as adhesive bonding (FIG. 24). Preferably the magnets are received within a pair of generally circular shaped cavities 94 formed in the sole of the boot 90 and are secured in place therewithin by a suitable epoxy resin.

Figure 31:
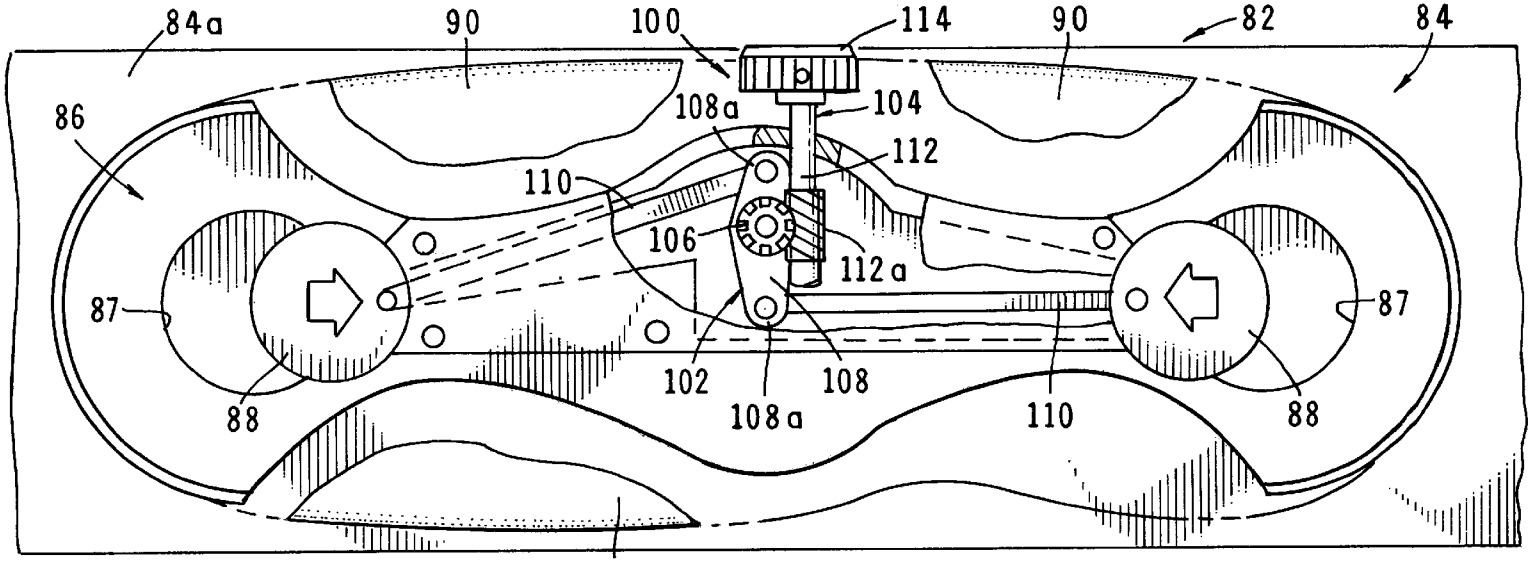
FIG. 31 is a plan view similar to FIG. 26 but showing the release means moved into a foot enclosure release configuration.
Figure 32:
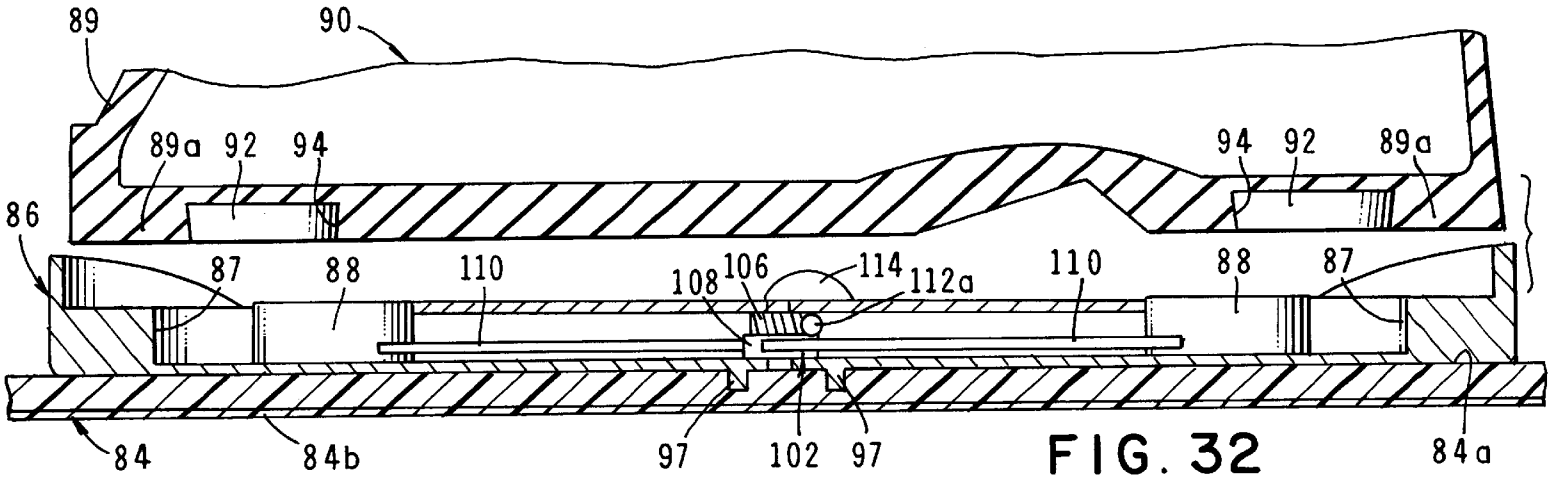
FIG. 32 is a cross-sectional view similar to FIG. 27 but showing the foot enclosure separated from the support base.

Forming an important aspect of the apparatus of this latest form of the invention is the previously mentioned connector means for releasably connecting the foot enclosure assembly 90 to the support base 84. As best seen by referring to FIGS. 26 and 27, connector frame 86 is of a generally barbell-like configuration and is securely affixed to the upper surface 84*a* of support 84 by connector pins 97. As indicated in FIGS. 26 and 31, second magnets 88 are slidably mounted within the oval shaped openings 87 for movement between a first position shown in FIG. 26 wherein the second magnets are in index with the first magnets 92 to a second position shown in FIG. 31 wherein the second magnets are displaced from the first magnets (see also FIG. 27).

Forming another extremely important aspect of the apparatus of the present invention is release means for disconnecting the foot enclosure assembly 90 from the connector means. In this latest embodiment of the invention, this important release means includes displacement means for controllably displacing second magnets 88 with respect to first magnets 92. This novel displacement means here comprises a displacement mechanism generally designated in the drawings by the numeral 100. Displacement mechanism 100 is operably associated with frame 86 for controllably sliding second magnets 88 within oval-shaped openings 87 from the first position shown in FIGS. 26 and 27, wherein the magnets are substantially aligned with the first magnets disposed within the boot of the enclosure means to a second position shown in FIG. 31, wherein the second magnets are displaced from and misaligned with the first magnets.

Figures 28, 29, 30:
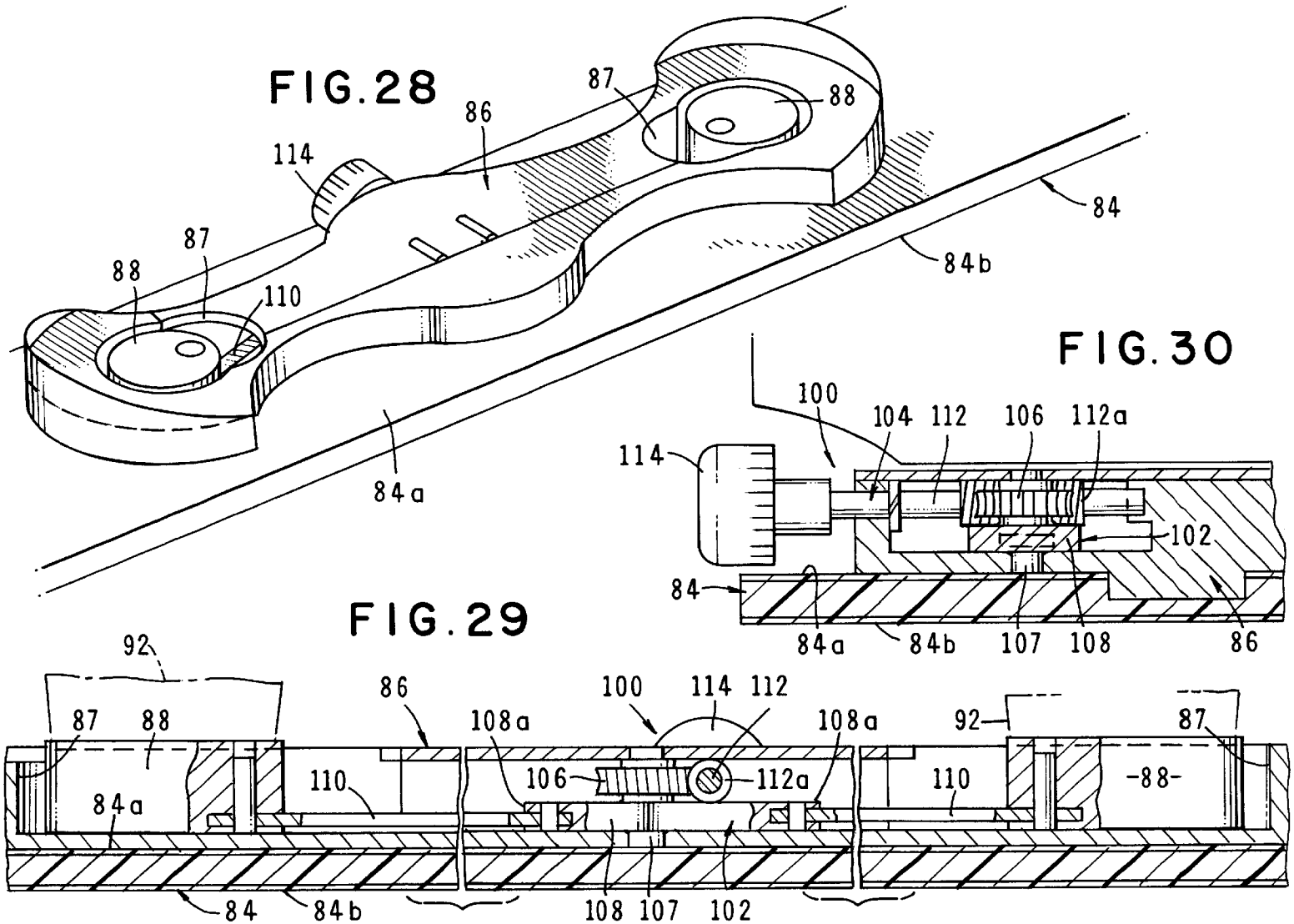
FIG. 28 is a generally perspective view of a portion of one form of the release means of this latest form of the invention.
FIG. 29 is a cross-sectional view taken along lines 29—29 of FIG. 26
FIG. 30 is a cross-sectional view taken along lines 30—30 of FIG. 26

This important displacement mechanism 100 of the invention here comnprises a driven member 102 which is rotatably connected to frame 86 for rotation between a first and a second position. Operably associated with driven member 102 is a driving member 104. As best seen in FIGS. 27 and 30, driven member 102 includes a conventional pinion gear 106 and a generally elliptically shaped head portion 108 which is connected to gear 106. Also forming a part of the displacement mechanism of the invention is a pair of connector links 110 which function to interconnect driven member 102 with second magnets 88. In the manner presently to be described, connector links 110 function to controllably move the second magnets within oval shaped guide openings 87 between the first and second positions upon rotation of the driven member 102 by the driving member 104.

In the present form of the invention, the driving member includes a rotatable shaft 112 having a rack portion 112*a* for engagement with pinion gear 106 in the manner shown in FIGS. 26, 29 and 30 and a finger gripping head portion 114 for gripping by the user of the apparatus to impart rotation to shaft 112 and to pinion gear 106 which is rotatable with a stub shaft 107 carried by frame 86 (FIG. 30). As indicated in FIGS. 26 and 30, shaft 112 is of a length such that finger gripping head 114 extends outwardly from frame 86 to enable easy rotation by the user of the apparatus.

In operating the unique displacement means of the invention, with head portion 108 of driven member 102 in the longitudinally extending position shown in FIG. 26, rotation of finger gripping head 114 will cause pinion gear 106 along with elliptical head 108, to rotate into the transversely extending position shown in FIG. 31. In the present form of the invention the connector links have their inboard ends connected to ends 108*a* of elliptical head portion 108 and their outboard ends connected to second magnets 88 in the manner shown in FIGS. 26 and 29. With this construction, movement of shaft 112 and elliptical head portion 108 into the second position shown in FIG. 31 will cause second magnets 88 to slide within oval shaped openings 87 toward the second displaced position shown in FIG. 31. It is apparent that as the second magnets are moved inwardly within oval shaped openings 87, they will move out of alignment with magnets 92 and as the second magnets become progressively more misaligned with the first magnets 92, the holding strength of the cooperating magnets will decrease. Accordingly, the displacement means can be used to controllably adjust the holding power of the magnets and, in turn, the force with which the foot enclosure means is secured to the connector means and to support 84. It is also apparent from a study of FIGS. 26 and 31 that as the second magnets reach their second innermost position, the gripping power between magnets 88 and 92 will lessen to such and extend that the foot enclosure means can be easily separated from the connector means and from support 84 in the manner shown in FIG. 32. Accordingly, the novel release means of the invention not only permits adjustment of the holding power of the magnets, it also permits the controlled release of the foot enclosure means from the connector frame.

Figure 33:
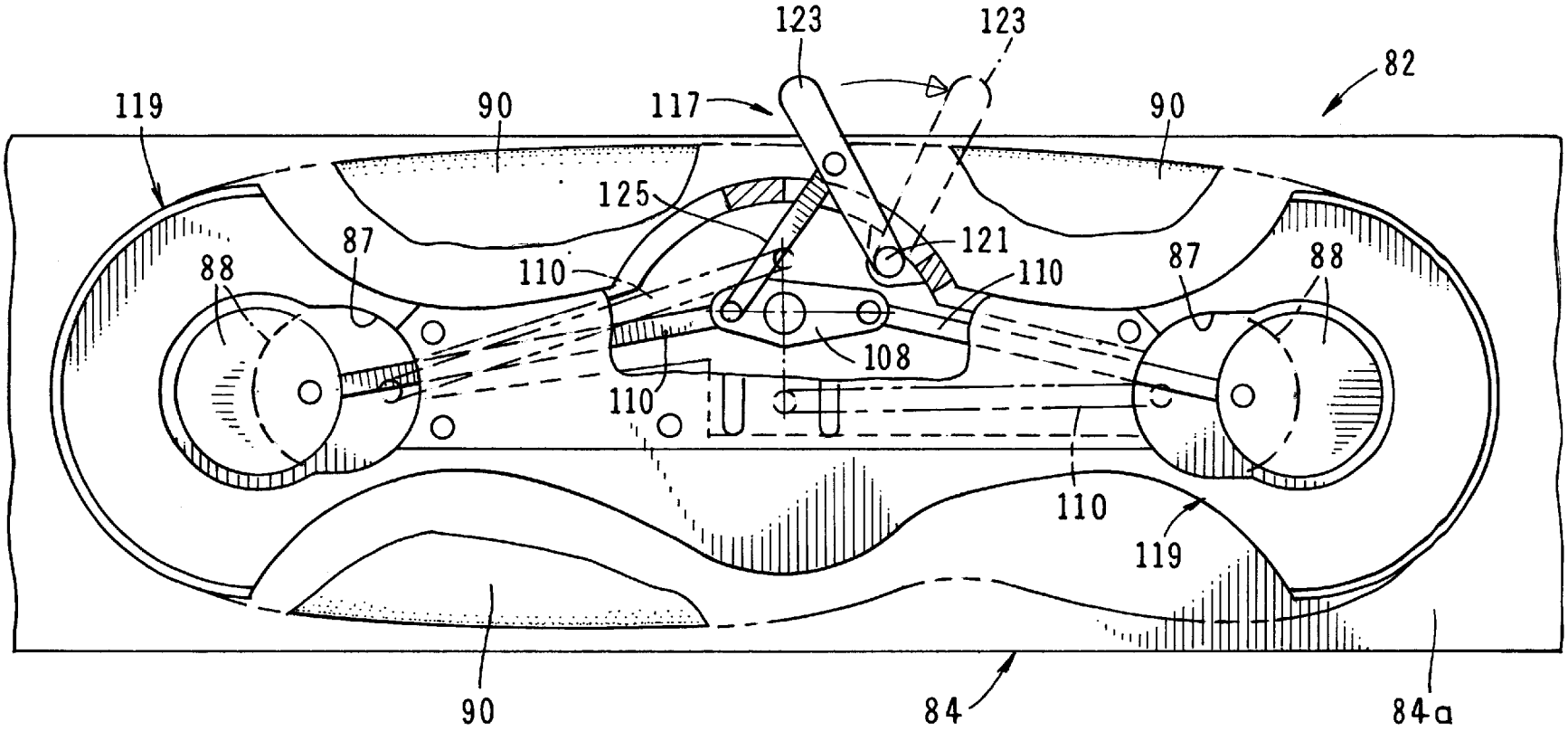
FIG. 33 is a plan view of an alternate form of release means of the invention.

It is to be understood that various mechanisms of a character well understood by those skilled in the art could be used to accomplish a sliding movement of magnets 88 within oval shaped openings 87. By way of example and not by way of limitation, magnets 88 could be moved from the first to the second position by displacement means comprising a linkage mechanism of the character illustrated in FIG. 33. More particularly, rather than rotating elliptical-shaped member 108 by means of the finger engaging wheel and gear arrangement shown in FIGS. 24 through 32, member 108 can be rotated by a linkage mechanism 117 of the character shown in FIG. 33. In this instance the linkage mechanism is carried by a connector frame 119 which is of a slightly different construction and includes a pivot pin 121 to which a driving member of linkage arm 123 is connected. A second linkage arm 125 is pivotally connected to an arm 123 and to member 108 so that a movement of arm 123 from the position shown in the sold lines of FIG. 33 to a position shown in the phantom lines will rotate member 108 into the release position. Other similar mechanical arrangements well known by those skilled in the art could be used to accomplish the movement of elliptical head portion 108.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

What is claimed is:

1. An apparatus for gliding over snow comprising:

(a) at least one foot enclosure assembly including a first magnet affixed thereto;

(b) at least one support base having an upper surface and a lower snow-engaging surface;

(c) connector means connected to said support base for releasably interconnecting said foot enclosure assembly with said support base, said connector means including a second magnet movable with respect to said first magnet; and (d) release means for disconnecting said foot enclosure assembly from said connector means, said release means including displacement means for displacing said second magnet relative to said first magnet, said connector means comprising a frame connected to said upper surface of said support base, said frame having an opening for slidably mounting said second magnet therewithin, said displacement means comprising a displacement mechanism operably associated with said frame for controllably sliding said second magnet within said opening between a first position wherein said second magnet is substantially aligned with said first magnet to a second position wherein said second magnet is misaligned with said first magnet, said displacement mechanism comprising:

(i) a driven member connected to said frame for movement between a first position and a second position, said driven member having a pinion gear and a head portion connected to said pinion gear;

(ii) a driving member operably associated with said driven member for rotating said driven member relative to said frame, said driving member including a rotatable shaft having a rack portion in engagement with said pinion gear to impart rotation to said pinion gear and to said head portion upon rotation of said rotatable shaft; and (iii) a connector link connected to said head portion of said driven member thereby interconnecting said driven member with said second magnet for controllably moving said second magnet toward said second position upon rotation of said driven member by said driving member.

2. The apparatus as defined in claim 1 in which said driving member further includes a finger gripping head connected to said rotatable shaft for imparting rotation thereto.

3. An apparatus as defined in claim 1 in which said head portion is generally elliptical in shape and includes opposing ends, said connector link being connected to a selected one of said opposing ends.

4. An apparatus for gliding over snow comprising:

(a) at least one foot enclosure assembly including a first magnet affixed thereto;

(b) at least one support base having an upper surface and a lower snow engaging surface (c) connector means connected to said upper surface of said support base for releasably connecting said foot enclosure assembly to said support base, said connector means comprising:

(i) a frame;

(ii) at least one second magnet mounted on said frame for engagement with said first magnet, said second magnet being movable between a first position and a second position, said second magnet being substantially aligned with said first magnet when said second magnet is in said first position; and (iii) release means carried by said frame for releasing said foot enclosure assembly from said support, said release means including displacement means for moving said second magnet between said first and second positions, said displacement means comprising:

a. a driven member rotatably connected to said frame for movement between a first position and a second position, said driven member comprising a generally elliptical-shaped member and a gear connected to said generally elliptical-shaped member;

b. a driving member operably associated with said driven member for rotating said driven member, said driving member including a rotatable shaft having a rack portion for engagement with said gear to impart rotation thereto upon rotation of said shaft;

c. a connector link connected to said generally elliptical-shaped member for moving said second magnet toward said second position upon rotation of said driven member by said driving member.

5. The apparatus as defined in claim 4 in which said driving member further includes a finger gripping head connected to said rotatable shaft for imparting rotation thereto.

6. An apparatus for gliding over snow comprising:

(a) a pair of foot enclosures, each having a first magnet affixed thereto and each having a support base having connector means connected thereto, said connector means having a second magnet connected thereto;

(b) a pair of support bases each having an upper surface and a lower snow-engaging surface;

(c) connector means connected to each of said support bases for releasably interconnecting a selected one of said pair of foot enclosures with said support base, each said connector means including a second magnet movable with respect to said first magnet and each comprising a frame connected to said upper surface of a selected one of said support bases, said frame having a generally oval shaped opening for slidably mounting said second magnet therewithin; and (d) release means for disconnecting said foot enclosures from said connector means, each said release means including displacement means for displacing said second magnet relative to said first magnet, each said displacement means comprising a displacement mechanism operably associated with said frame for controllably sliding said second magnet within said generally oval shaped opening between a first position wherein said second magnet is substantially aligned with said first magnet to a second position wherein said second magnet is misaligned with said first magnet, said displacement mechanism comprising:

(i) a driving member connected to said frame for rotation between a first position and a second position, said driving member including a rotatable shaft having a rack portion;

(ii) a driven member operably associated with said driving member, said driven member including a pinion gear and a head portion connected to said pinion gear, said pinion gear engaging said rack portion of said rotatable shaft to impart rotation to said pinion gear and to said head portion upon rotation of said rotatable shaft ;and (iii) a connector link connected to said head portion thereby interconnecting said driven member with said second magnet for controllably moving said second magnet toward said second position upon rotation of said driven member by said driving member.

7. The apparatus as defined in claim 6 in which said driving member further includes a finger gripping head connected to said rotatable shaft for imparting rotation thereto.

* * * * *